US005435778A

United States Patent [19]

Castle et al.

[11] Patent Number: 5,435,778

[45] Date of Patent: Jul. 25, 1995

[54] ROTARY COIN COUNTER

[75] Inventors: Steven T. Castle; Daniel J. Waller, both of Reno, Nev.

[73] Assignee: International Game Technology, Reno, Nev.

[21] Appl. No.: 41,708

[22] Filed: Apr. 2, 1993

[51] Int. Cl.[6] ..... G07D 9/04

[52] U.S. Cl. ..... 453/32; 221/267; 453/35

[58] Field of Search ..... 453/32, 35, 50; 221/7, 221/267

[56] References Cited

U.S. PATENT DOCUMENTS

| | | | |
|---|---|---|---|
| 1,808,270 | 6/1931 | Vogt | 453/35 |
| 4,216,788 | 8/1980 | Watanabe et al. | 453/32 |
| 4,592,377 | 6/1986 | Paulsen et al. | 453/33 |
| 4,746,319 | 5/1988 | Zwieg et al. | 453/32 |
| 4,923,430 | 5/1990 | Iimura | 453/50 |

*Primary Examiner*—F. J. Bartuska
*Attorney, Agent, or Firm*—Edward J. Keeling; Marc D. Foodman

[57] ABSTRACT

The present invention is directed to a coin counter for use with a coin handling apparatus for receiving coins at a first location and discharging the coins at a second location through a coin discharge slot remote from the first location. The coin handling apparatus includes a coin transport channel extending from the first location to the second location and dimensioned so that coins can move therein in a single, edge-to-edge file. The channel terminates at the coin discharge slot at the second location. A sensor is located proximate to the coin discharge slot for sensing the passage of each coin as it leaves the channel through the coin discharge slot. A counter means is coupled with the sensor for counting the total number of coins passing through the coin discharge slot.

30 Claims, 5 Drawing Sheets

ROTARY COIN COUNTER

BACKGROUND OF THE INVENTION

This invention relates to coin handling in payout apparatus such as slot machines or similar gaming or amusement devices and in particular to a reliable means for counting coins discharged from such devices and for controlling the total number of coins paid out.

Heretofore gaming devices often use an elongated duct to transfer coins from a payout hopper to a coin tray, such as when the coin tray is elevated from the hopper. In one such prior art design, coins are pushed through the duct by the hopper and out a discharge slot at the end of the duct into payout tray. A pin with a roller which is held in place by a spring prevents the coin nearest the slot from going through the outlet slot until pressure is applied to the roller by an upwardly moving column of coins during a payout. When a coin pushes against the roller, the spring stretches and the roller moves, allowing the coin to exit. As a coin exits, the spring pulls the roller back into a position to block the next coin while imparting velocity to the exiting coin. A drawback of this mechanism is that coins can be stolen by inserting a paper clip or other device into the outlet slot and pushing the roller back while "fishing" out a coin.

In certain gaming devices of the type described above, a counter is placed on the payout hopper near where the hopper connects to the elongated duct to count the correct number of coins during a payout. Because of the varying diameters of tokens used by various casinos, the stack height of coins in the elongated duct between the counter and the outlet slot of the duct could vary by as much as ½ inch or more. This variation can result in counting errors and thus overpays or underpays during a coin payout.

Another device illustrated in U.S. Pat. No. 4,592,377 issued to the assignee of the present invention provides coin handling apparatus for receiving coins at one end of a coin transport channel, feeding the coins through the channel in single edge-to-edge file and discharging the coins through an outlet slot at the outlet end of the channel. A security device located at the outlet end of the channel is in contact with a first coin next to the outlet slot and a second coin farther from the outlet slot. The security device prevents the first coin from being discharged through the outlet slot unless the first and second coins move simultaneously and with substantially equal speeds toward the outlet slot.

The security device is a rocker arm located at the end of the channel with a first and second pin extending through the channel for contacting a first and second coin, and with a pivot around which the rocker arm rotates. When a coin is being ejected, the first pin rolls along the edge of the first coin away from the outlet slot, while the second pin rolls along the edge of a second coin towards the center of the channel into the "V" area between the second coin and a third coin. After the first coin is ejected, the rocker arm is returned to its original position by a spring. In this position, the first coin cannot be pulled from the outlet slot by a thief because it is blocked by the first pin. The thief cannot simply push the first pin back as in previous designs because the rocker arm rigidly connects the first pin to the second pin and the second pin will not move while it is blocked by the second coin, and it will be blocked by the second coin until the coins are forced through the channel during a payout.

A counter is placed near the outlet slot, rather than close to the hopper, to prevent counting errors due to varying heights of the stack of coins in the duct. The counter is activated each time the rocker arm pivots. When the counter reaches the number of coins to be ejected, no more coins are fed into the channel by the hopper.

The second pin can cause binding of the coins in the channel if the diameter of the coins varies because the second pin is located so that it will engage the periphery of an ideal diameter coin. This binding is eliminated by adjustably mounting the second pin in a slot in the rocker arm. The slot allows the roller of the "V" areas between the second and third coins as a result of coin stack height variations due to differences in the coin diameter, thereby preventing the coins from binding up.

SUMMARY OF THE INVENTION

Broadly, the invention is directed to a coin handling apparatus for receiving coins at a first location and discharging the coins at a second location through a coin discharge slot remote from the first location. A coin transport channel is provided and extends from the first location to the second location. The coin transport channel is dimensioned so that coins can move therein in a single, edge-to-edge file. The channel terminates at the coin discharge slot at the second location. Sensor means are located proximate to the coin discharge slot for sensing the passage of each coin as it leaves the channel through the coin discharge slot. Counter means are coupled with the sensor means for counting the number of coins passing through the coin discharge slot. The sensor means includes a rotator assembly positioned adjacent to the coin discharge slot. The rotator assembly is contacted with coins being discharged through the coin discharge slot which cause the rotator assembly to rotate. Means are provided on the rotation assembly to activate a means for detecting the discharge of each coin being discharged through the coin discharge slot. The activity means triggers a counter means each time a coin is discharged whereby the total number of coins leaving the coin discharge slot is counted.

In a more specific aspect, the present invention provides a coin handling apparatus for receiving coins at a first location and discharging the coins at a second location through a coin discharge slot remote from the first location. A coin transport channel is extended from the first location to the second location and dimensioned so that coins can move therein in a single, edge-to-edge file. The channel terminates at the coin discharge slot at the second location. A rotary coin counter is positioned adjacent to said discharge slot. The rotary coin counter includes a bolt fixedly connected to the transport channel. A rotator core having a central base is disposed on the bolt for rotation thereon. Means on the rotator core are adapted to contact each coin as it moves through the coin transport channel toward the coin discharge slot for rotating the rotator core in response to coin movement. Flag elements are radially spaced apart on the outer portion of the rotator core for rotation therewith. Optical sensor means are positioned to be responsive to rotation of said flag elements for sensing passage of each coin through the coin discharge slot and counting means coupled to the optical sensor means count coins discharged through the coin discharge slot.

OBJECTS OF THE INVENTION

It is a general object of the present invention to provide an coin counter for use in gaming devices which is reliable when used with a coin escalator. A more specific object of the invention is the implementation of a coin counter which includes a rotator assembly which is caused to rotate by each coin being discharged from a coin escalator and an optical sensor means responsive to such rotation to count the coins being discharged. Further, objects and advantages of the present invention will become apparent from the following detailed description read in view of the accompanying drawings which are made a part of this specification.

DETAILED DESCRIPTION OF THE INVENTION

Figure 1:
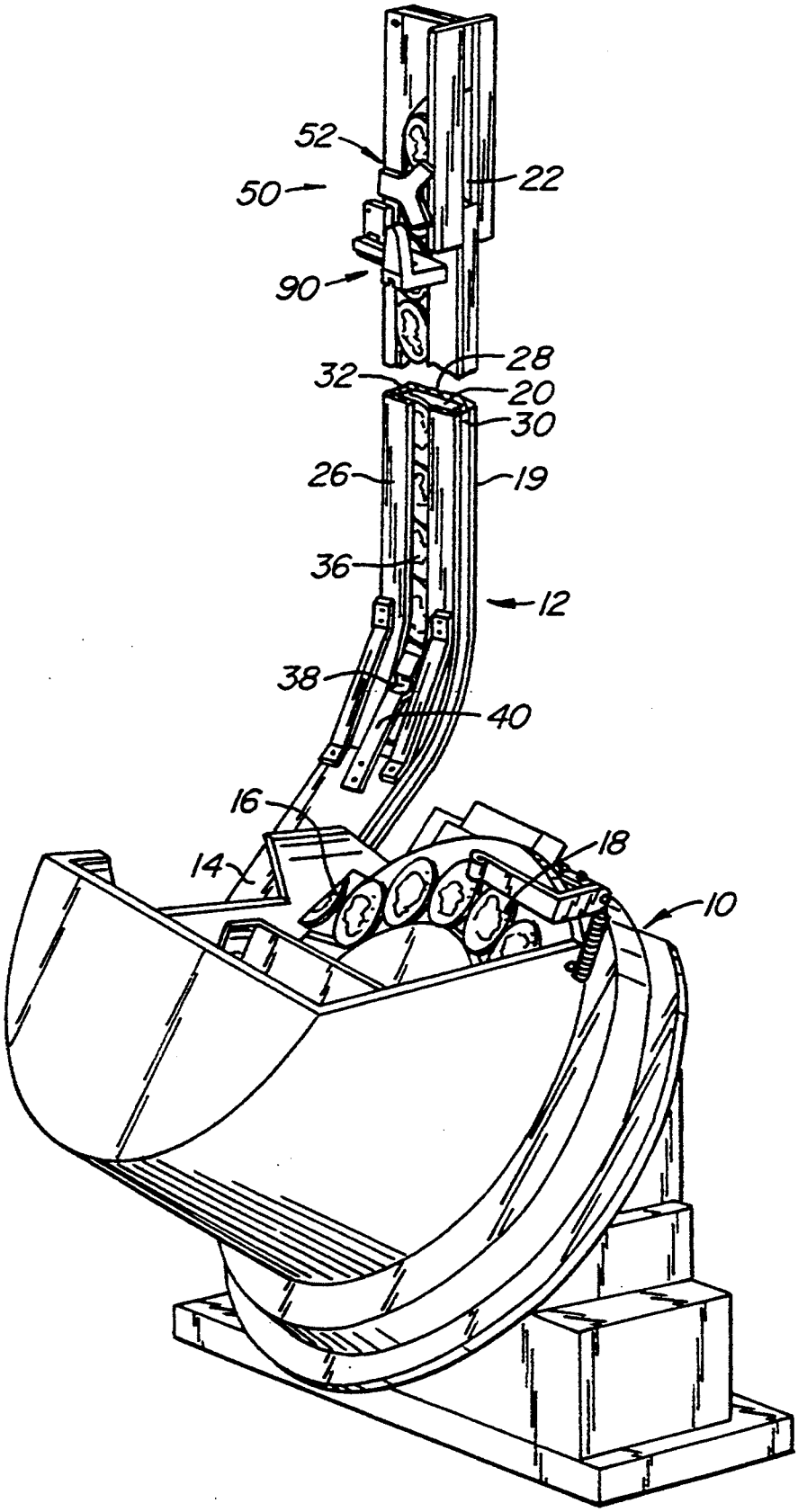
FIG. 1 is a perspective view of a coin hopper and the coin channel including the rotary coin counter of the present invention.

The present invention is best understood in connection with a specific coin hopper and coin transport mechanism such as described in the aforementioned U.S. Pat. No. 4,592,377. For complete presentation that coin handling coin hopper and coin transport mechanism will be again described herein. Thus, as illustrated in FIG. 1, there is shown a hopper 10 to which is secured a coin handling escalator assembly 12. The escalator is secured to the hopper adjacent its lower end 14 having an inlet 16 at the lower end through which coins 18 are received from the hopper. The escalator assembly comprises an elongated duct 19 having a channel 20 in which the stack of coins of a single given denomination are received in an edge-to-edge file and an outlet slot 22 adjacent the upper end 22 of the duct.

Duct 19 is made up of a front plate 26, a back plate 28 and a pair of edge panels or guides 30 and 32 secured together to define channel 20. Channel 20 has a depth between the front and back plates 26 and 28 greater than the thickness of the coin denominations handled by the escalator, but less than twice the thickness of the coins, thereby preventing the possibility of a coin slipping behind or in front of an adjacent coin which would cause them to jam in the channel. Of course, the width of channel 20 between edge panels 30 and 32 is also slightly greater than the diameter of the coins.

Front plate 26 has an access opening 36 along a substantial portion of its length allowing jamming or other interruption of the movement of coins therealong to be readily obviated by inserting a screwdriver or other Similar tool. This opening may also or alternately be present on back plate 28. An enlarged access opening 38 is preferably provided between upper and lower portions of front plate 26 into which a leaf spring 40 (or other suitable retention means) extends for urging the coins against the opposite back plate 28. The enlarged opening 38 is of a size sufficient to allow coins to be extracted through the opening, for example, to empty the channel for maintenance of the like.

Figure 2A:
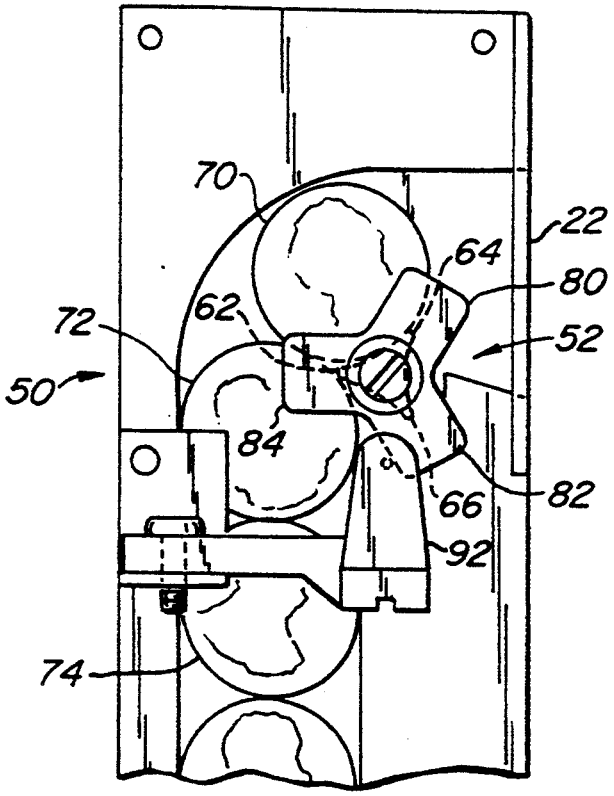
FIGS. 2A–2C are elevation views with portions broken away for clarity of presentation and illustrate the successive steps of the rotary coin counter in counting coins in accord with the present invention.
Figure 3A:
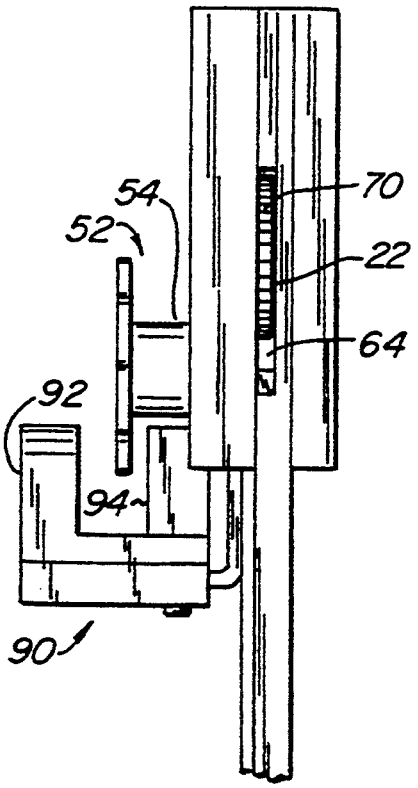
FIGS. 3A & 3B are side elevation views with portions removed for clarity of presentation if the rotary coin counter of the present invention as shown in FIGS. 2A and 2B.
Figure 2B:
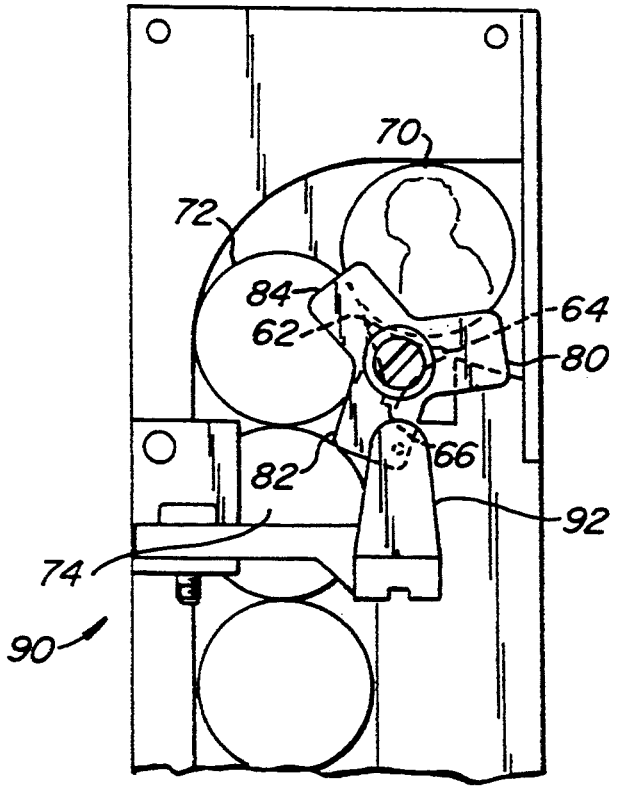
Figure 3B:
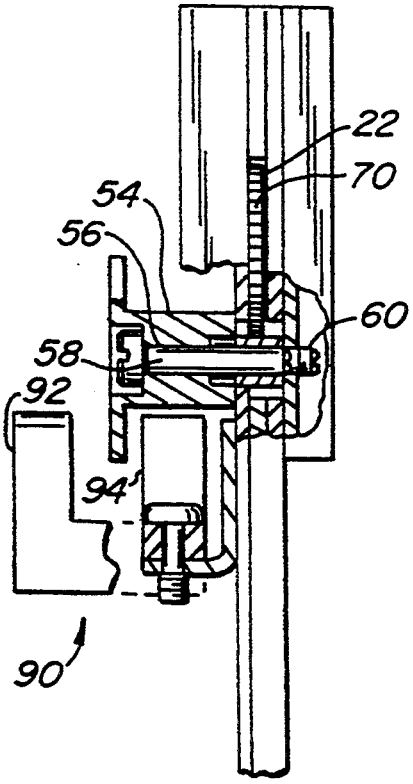
Figure 2C:
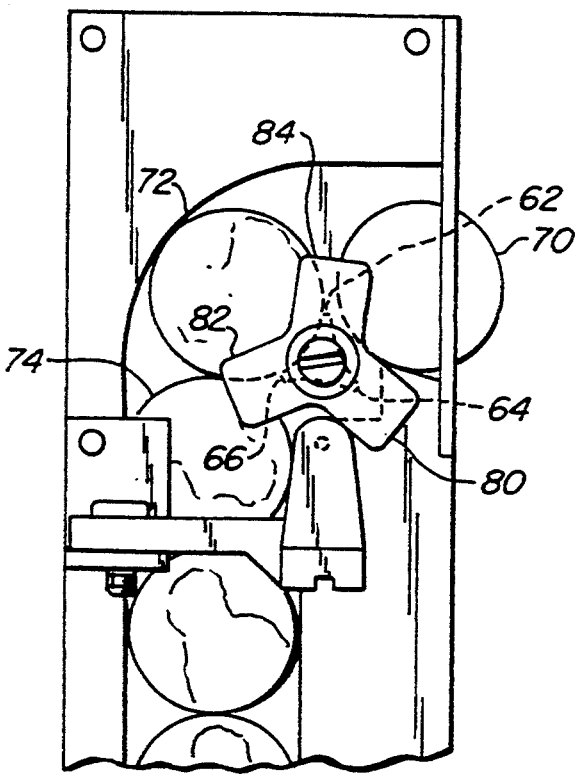

FIGS. 2A–2C show an elevation view with parts broken away for clarity of presentation of the outlet end of the escalator assembly 12. FIGS. 3A and 3B are side elevations of FIGS. 2A and 2B respectively. The rotary coin counter of the present invention is designated generally by the numeral 50. A coin sensing means such as rotator assembly 52 is positioned adjacent to the coin discharge slot 22. The rotator assembly 52 is positioned so that coins moving up the escalator assembly 12 will contact the rotary assembly prior to exiting through coin discharge slot 22.

The rotator assembly includes a rotator core 54 having a central bore 56 formed therethrough. The rotator core is rotationally mounted in a position suitable to contact coins by a suitable bolt 58 and retaining nut 60. Alternatively, the bolt may have threads on its outer end and be screwed into threads provided in the escalator assembly. In any event the bolt is fixed mounted to the escalator assembly to provide a shaft about which the rotator core may rotate. The rotor core has lobes, such as lobes 62, 64, 66, at its inner end suitable for contacting coins advancing up the escalator assembly. As is evident from a comparison of FIGS. 2A–2C, coins 70, 72, 74 contact lobes 64, 62, 66, respectively as the coins move up the escalator assembly 12, toward the outlet slot 22, causing the rotator assembly 52 to rotate around bolt 58.

A plurality of radially extending rotor flag elements, 80, 82, 84, are connected to the rotor core 54 and rotate therewith in response to coin movement up and out of the escalator assembly. Preferably, as illustrated in FIGS. 2A–2C, three rotor flag elements are provided and arranged to rotate 120° as each coin moves from an initial contact with a lobe to ejection out of outlet slot 22.

A coin counter means is provided and interacts with the coin sensing means to count the number of coins passing out of the coin discharge slot. Thus, in preferred form, an optical counter means indicated generally by the number 90 is connected in position to be activated by passage of the flag elements 80, 82, 84 of the rotator assembly 52. The optical sensor may for example be an infrared sensing device which would include a source of infrared light 92. A counter 94 is coupled to the optical sensor and is activated each time the beam of infrared light is interrupted by a flag element. The flag elements 80, 82, 84 are positioned on the rotator core 54 so as to interrupt the light beam for passage of a given number of coins. In preferred form, the flag elements interrupt the infrared beam once for each coin that is ejected out of the outlet slot.

Thus, in accordance with the invention a coin handling apparatus for receiving coins at a first location and discharging the coins at a second location through a coin discharge slot remote from the first location is provided and includes means defining a coin transport channel extending from the first location to the second location and dimensioned so that coins can move therein in a single, edge-to-edge file. The channel terminates at the coin discharge slot at the second location. Optical sensor means are located proximate to the coin discharge slot for sensing the passage of each coin as it leaves the channel through the coin discharge slot and counter means are activated by the optical sensor means for counting the number of coins passing through the coin discharge slot.

In an alternative embodiment of the invention, it is contemplated that the optical sensor means may be replaced with means for generating a magnetic field which is arranged to be interrupted by a flag element each time a coin is discharged form the discharge slot. Breaking the magnetic field would activate a counter so as to count the number of coins leaving coin discharge slot.

A problem associated with counting coins moving up an escalator assembly involves the typical jitter and vibration of the coins as they move in edge-to-edge fashion up the assembly. It is not uncommon for the coins to pause momentarily or even fall backwards slightly as they move toward the outlet slot. The effects of vibrations and monetary reversal of direction of the coins can result in the flag elements inadvertently interrupting the optical sensor resulting in false counting of the coins. The present invention includes means for inhibiting free rotation of the rotator assembly to solve the problem and ensure an accurate count of the coins exiting the escalator assembly.

Figure 4A:
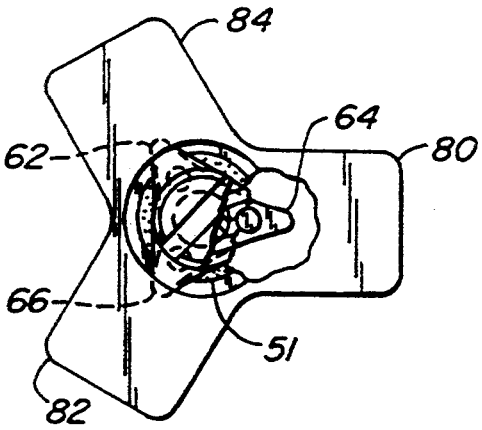
FIG. 4A is an elevation view with parts removed for clarity of presentation showing an embodiment of a rotor assembly assembled in accordance with the present invention.
Figure 4B:
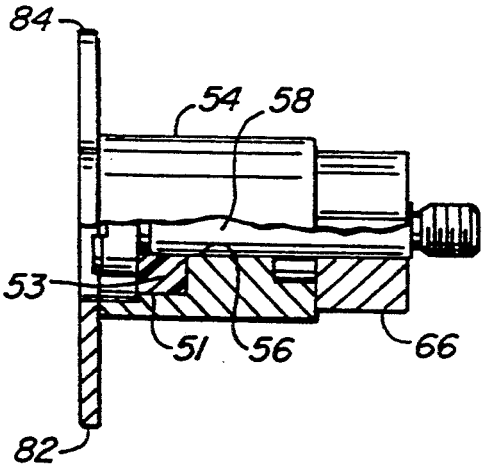
FIG. 4B is a side elevation partially in section of the rotor assembly of FIG. 4A.

With particular reference to FIGS. 4A and 4B, a radial resistance means is shown for use in the rotator assembly 52 and is useful to insure that as the coins contact the lobes 62, 64, 66 of the rotator core 54 they do not cause the flag elements to inadvertently block the infrared beam and give a false count. Thus, a drag or resistance means is added to the rotor assembly to provide a slight resistance to the rotational movement of the rotator core. A suitable recession or pocket such as triangular pocket 51 is formed in the rotor core 54. A suitably shaped resistant insert 53 such as a triangular shaped piece of urethane is fitted into the recess. The insert 53 has a central bore formed slightly smaller than the diameter of shoulder bolt 58 to thus provide a drag or resistance to the rotation of the rotor core 54 about the bolt.

Figure 5A:
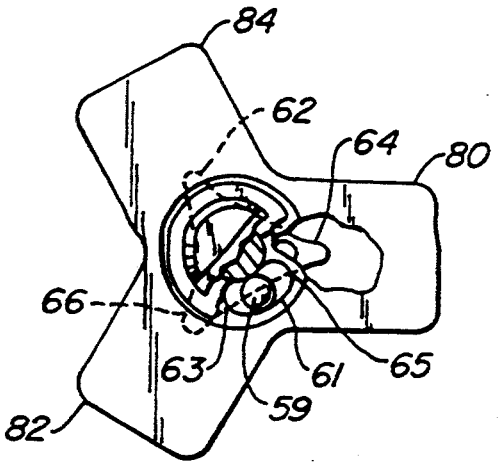
FIG. 5A is an elevation view with parts removed for clarity of presentation and shows another embodiment of the rotary assembly in accordance with the present invention.
Figure 5B:
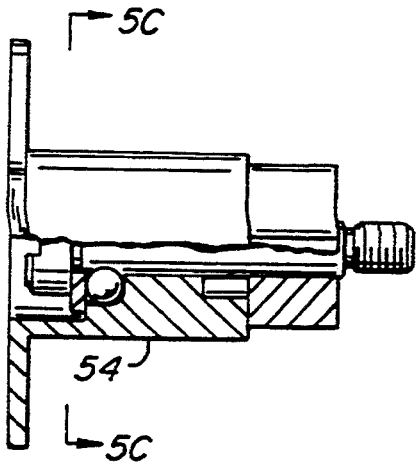
FIG. 5B is a side elevation partially in section of the rotor assembly of FIG. 5A.
Figure 5C:
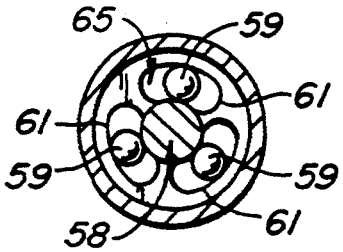
FIG. 5C is a sectional view taken at C—C of FIG. 5B.

Another arrangement for preventing free rotation of the rotator assembly in an undesirable direction is shown in FIGS. 5A, 5B and 5C. Three radially spaced apart kidney bean shaped pockets 61 are formed in the outer portion of the rotator core 54. A ball bearing 59 is located in each of the pockets. Each pocket is formed so that the ball bearing is free to move smoothly in the rearward with respect to the desired direction of rotation portion 65 of the pocket 61. A reduced size portion 63 of the pocket is located in the forward portion of the pocket with respect to the desired direction of rotation of the rotator assembly. Thus, when clockwise rotation is desired for counting coins the reduced size portion 63 is located in the direction of rotation.

If the rotator is rotated in a clockwise direction by coins moving up escalator assembly, the ball bearings ride smoothly in the pockets on the shoulder bolt 58 generating little or no resistance to clockwise rotation. If the coin stack jitters and the rotator assembly attempts to rotate counterclockwise, then at least one of the three balls will move towards the reduced size portion of the pocket and pinches between the surface of this portion of the pocket and the shoulder bolt to prevent the rotator assembly from moving counterclockwise.

Figure 6A:
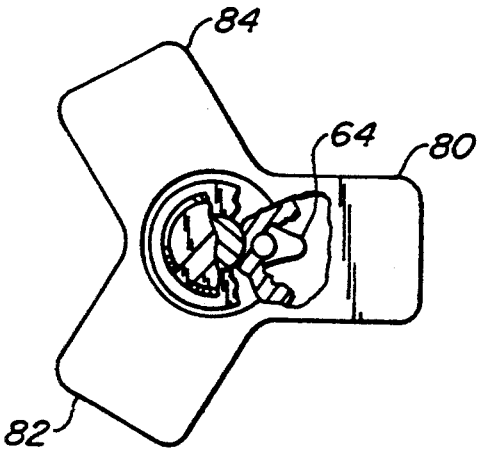
FIG. 6A is an elevation view with parts removed for clarity of presentation and shows another embodiment of the rotary assembly in accordance with the present invention.
Figure 6B:
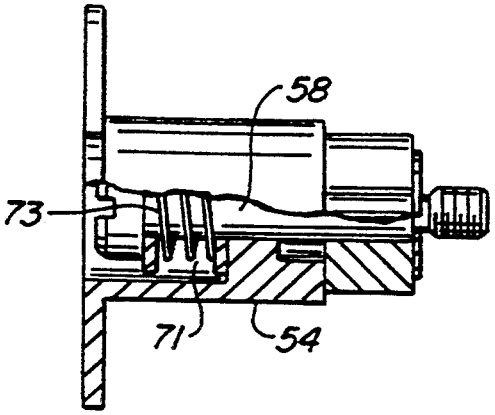
FIG. 6B is a side elevation partially in section of the rotary assembly of FIG. 6A.

Another means for inhibiting rotation in the undesirable direction is shown in FIGS. 6A and 6B. An annular recess 71 is formed in the outer portion of rotator core 54. A spring 73 is positioned around the shoulder bolt 58 and is sealed between the bottom surface of the recess 71 and the head of the bolt 58. The spring is compressed a desired amount to provide resistance to rotational motion so that if a back up in the coin stack does occur, the rotator element will not reverse rotation and thus cause a flag element to falsely break the optical beam.

Figure 7:
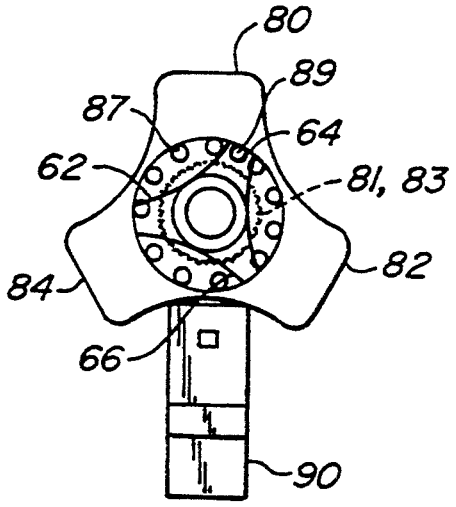
FIG. 7 is a front elevation view with parts removed for clarity of presentation and shows the preferred embodiment of the rotator assembly in accordance with the present invention.
Figure 8:
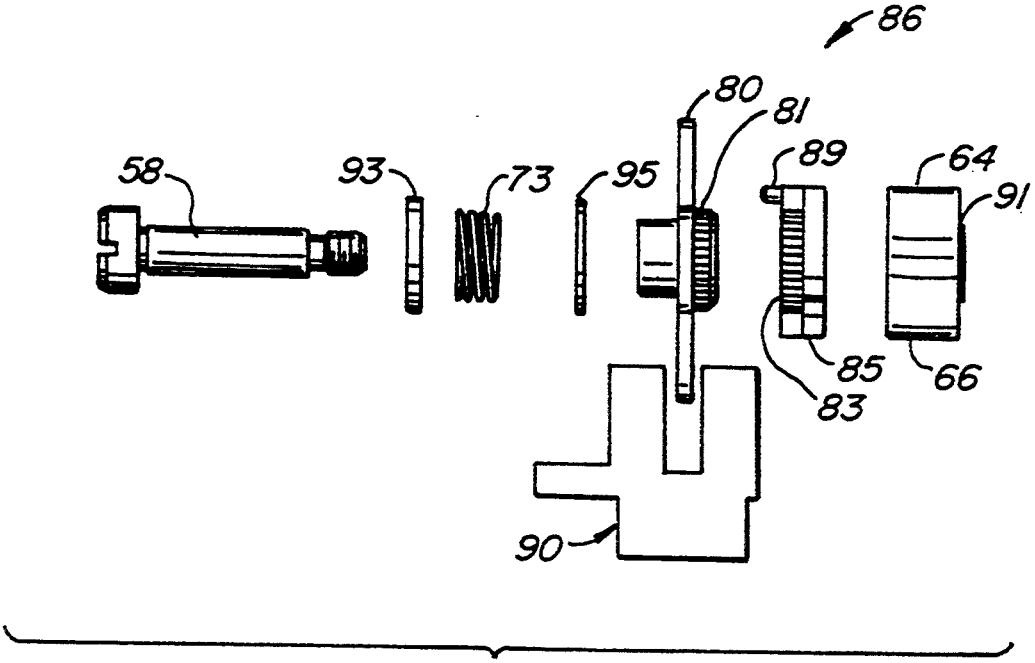
FIG. 8 is an exploded side view of the preferred embodiment of FIG. 7.

FIG. 7 and FIG. 8 show the preferred embodiment of apparatus assembled in accordance with the present invention for inhibiting rotation of the rotator assembly in an undesirable direction and for providing a rotatory assembly that is readily adjustable to accommodate coins of various denomination i.e. different sizes. For ease of reference, parts common to the other embodiments will be identified with the same numerals. As is shown, the optical counter 90 is operatively positioned to be activated by flags 80, 82, 84 as they pass through the counter. The flag assembly, which is preferably plastic, includes a splined portion 81 which is adapted to mate with a splined portion 83 located interiorly of plastic rotor mount 85. A series of phase angle holes 87 are spaced around the interior portion of the flags. Twelve such holes are preferred. An alignment pin 89 extends from the rotor mount 85 and is adapted to be inserted into one of the phase angle holes 87. A 3-lobed rotor 91 is keyed into the rotor mount 85 for rotation therewith. By changing the position of the alignment pin 89 with respect to the phase angle holes 87 the alignment between the flags 80, 82, 84 and the lobes 62, 64, 66 can be changed to better accommodate coins of difference sizes. A shoulder screw 58 passes through washers 93, 95 and spring 73 as well as the flag assembly and the 3-lobed rotor 91 and is attached to the back plate 28 of the escalator assembly to prevent undesirable rotation.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, all such variations and changes, which fall within the spirit and scope of the present invention as defined in the following claims, are expressly intended to be embraced thereby.

What is claimed is:

1. A coin handling apparatus for receiving coins at a first location and discharging the coins at a second location through a coin discharge slot remote from the first location comprising means defining a coin transport channel extending from the first location to the second location and dimensioned so that coins can move therein in a single, edge-to-edge file, the channel terminating at the coin discharge slot at the second location; assembly positioned adjacent the coin discharge slot contactable with coins being discharged through said coin discharge slot, said coins causing said rotor sensor assembly to rotate and activate a means for detecting the discharge of each coin being discharged from said coin discharge slot, means for inhibiting rotation of the rotor sensor assembly in an undesirable direction comprising a compression spring positioned around a bolt through the core of the rotor sensor assembly inhibiting free rotation by applying a force in the axial direction, and counter means activated by said rotor sensor assembly for counting each coin leaving said coin discharge slot to provide a count of the total number of coins passing through said coin discharge slot.

2. The coin handling apparatus of claim 1 further characterized in that the rotor sensor assembly includes an optical sensor means and that the counter means is activated by said optical sensor means.

3. The coin handling apparatus of claim 1 further characterized in that the rotor sensor assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotor sensor assembly and rotor flag elements on said rotor sensor assembly arranged with respect to said lobes to interrupt a light beam of an optical sensor each time a coin is discharged from said coin discharge slot.

4. The coin handling apparatus of claim 2 further characterized in that the rotator assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotator assembly and rotor flag elements on said rotator assembly arranged with respect to said lobes to interrupt a light beam of said optical sensor each time a coin is discharged from said coin discharge slot.

5. The coin handling apparatus of claim 2 further characterized in that the rotor sensor assembly positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotor sensor assembly, rotor flag elements on said rotor sensor assembly arranged with respect to said lobes to interrupt a light beam of said optical sensor each time a coin is discharged from said coin discharge slot said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotor sensor assembly to accommodate coins of different sizes.

6. A coin handling apparatus for receiving coins at a first location and discharging the coins at a second location through a coin discharge slot remote from the first location comprising means defining a coin transport channel extending from the first location to the second location dimensioned so that coins can move therein in a single, edge-to-edge file, the channel terminating at the coin discharge slot at the second location and a rotary coin counter positioned adjacent to said discharge slot, said rotary coin counter comprising a bolt fixedly connected to said transport channel, a rotator core having a central base disposed on said bolt for rotation thereon; means on said rotator core for contacting each coin as it moves through said coin transport channel toward said coin discharge slot for rotating said rotator core in response to coin movement, flag elements radially spaced apart on the outer portion of said rotator core for rotation therewith; sensor means positioned to be responsive to rotation of said flag elements for sensing passage of each coin through the coin discharge slot; counting means coupled to said sensor :means for counting coins discharged through said coin discharge slot; and means for inhibiting rotation of the rotator core in an undesirable direction characterized in that the means for inhibiting rotation of the rotary coin counter comprises a compression spring positioned around the bolt through the rotator core inhibiting free rotation by applying a force in the axial direction.

7. The coin handling apparatus of claim 6 further characterized in that said sensor means are optical sensor means arranged with respect to said flag elements to so that a light beam of said optical sensor means is interrupted each time a coin causes said rotary coin counter to rotate.

8. The coin handling apparatus of claim 6 further characterized in that the rotary coin counter positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotary coin counter, rotor flag elements on said rotary coin counter arranged with respect to said lobes to interrupt a light beam of said optical sensor each time a coin is discharged from said coin discharge slot said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotary coin counter to accommodate coins of different sizes.

9. The coin handling apparatus of claim 6 further characterized in that the rotary coin counter includes an optical sensor means and that the counting means is activated by said optical sensor means.

10. The coin handling apparatus of claim 6 further characterized in that the rotary coin counter positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotary coin counter and rotor flag elements on said rotary coin counter arranged with respect to said lobes to interrupt a light beam of an optical sensor each time a coin is discharged from said coin discharge slot.

11. A coin handling apparatus for receiving coins at a first location and discharging the coins at a second location through a coin discharge slot remote from the first location comprising means defining a coin transport channel extending from the first location to the second location and dimensioned so that coins can move therein in a single, edge-to-edge file, the channel terminating at the coin discharge slot at the second location; assembly positioned adjacent the coin discharge slot contactable with coins being discharged through said coin discharge slot, said coins causing said rotor sensor assembly to rotate and activate a means for detecting the discharge of each coin being discharged from said coin discharge slot, means for inhibiting rotation of the rotor sensor assembly in an undesirable direction comprising a resilient insert contacting a bolt through the core of the rotor sensor assembly by applying resistance in a circumferential direction, and counter means activated by said rotor sensor assembly for counting each coin leaving said coin discharge slot to provide a count of the total number of coins passing through said coin discharge slot.

12. The apparatus of claim 11 further characterized in that the rotor sensor assembly includes an optical sensor means and that the counter means is activated by said optical sensor means.

13. The coin handling apparatus of claim 11 further characterized in that the rotor sensor assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotor sensor assembly and rotor flag elements on said rotor sensor assembly arranged with respect to said lobes to interrupt a light beam of an optical sensor each time a coin is discharged from said coin discharge slot.

14. The coin handling apparatus of claim 12 further characterized in that the rotor sensor assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotor sensor assembly and rotor flag elements on said rotor sensor assembly arranged with respect to said lobes to interrupt a light beam of said optical sensor each time a coin is discharged from said coin discharge slot.

15. The coin handling apparatus of claim 12 further characterized in that the rotor sensor assembly positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotor sensor assembly, rotor flag elements on said rotor sensor assembly arranged with respect to said lobes to interrupt a light beam of said optical sensor each time a coin is discharged from said coin discharge slot, said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotor sensor assembly to accommodate coins of different sizes.

16. A coin handling apparatus for receiving coins at a first location and discharging the coins at a second location through a coin discharge slot remote from the first location comprising means defining a coin transport channel extending from the first location to the second location and dimensioned so that coins can move therein in a single, edge-to-edge file, the channel terminating at the coin discharge slot at the second location; assembly positioned adjacent the coin discharge slot contactable with coins being discharged through said coin discharge slot, said coins causing said rotor sensor assembly to rotate and activate a means for detecting the discharge of each coin being discharged from said coin discharge slot, means for inhibiting rotation of the rotor sensor assembly in an undesirable direction comprising means for inhibiting rotation of the rotary coin counter including ball bearings located in the core of the rotor sensor assembly permitting free rotation in one direction and resisting rotation in the opposite direction by applying a radially directed force, and counter means activated by said rotor sensor assembly for counting each coin leaving said coin discharge slot to provide a count of the total number of coins passing through said coin discharge slot.

17. The apparatus of claim 16 further characterized in that the rotor sensor assembly includes an optical sensor means and that the counter means is activated by said optical sensor means.

18. The coin handling apparatus of claim 16 further characterized in that the rotor sensor assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotor sensor assembly and rotor flag elements on said rotor sensor assembly arranged with respect to said lobes to interrupt a light beam of an optical sensor each time a coin is discharged from said coin discharge slot.

19. The coin handling apparatus of claim 17 further characterized in that the rotor sensor assembly positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotor sensor assembly and rotor flag elements on said rotor sensor assembly arranged with respect to said lobes to interrupt a light beam of said optical sensor each time a coin is discharged from said coin discharge slot.

20. The coin handling apparatus of claim 17 further characterized in that the rotor sensor assembly positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotor sensor assembly, rotor flag elements on said rotor sensor assembly arranged with respect to said lobes to interrupt a light beam of said optical sensor each time a coin is discharged from said coin discharge slot, said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotor sensor assembly to accommodate coins of different sizes.

21. A coin handling apparatus for receiving coins at a first location and discharging the coins at a second location through a coin discharge slot remote from the first location comprising means defining a coin transport channel extending from the first location to the second location dimensioned so that coins can move therein in a single, edge-to-edge file, the channel terminating at the coin discharge slot at the second location and a rotary coin counter positioned adjacent to said discharge slot, said rotary coin counter comprising a bolt fixedly connected to said transport channel, a rotator core having a central base disposed on said bolt for rotation thereon; means on said rotator core for contacting each coin as it moves through said coin transport channel toward said coin discharge slot for rotating said rotator core in response to coin movement, flag elements radially spaced apart on the outer portion of said rotator core for rotation therewith; sensor means positioned to be responsive to rotation of said flag elements for sensing passage of each coin through the coin discharge slot; counting means coupled to said sensor means for counting coins discharged through said coin discharge slot; and means for inhibiting rotation of the rotator core in an undesirable direction characterized in that the means for inhibiting rotation of the rotator core is a resilient insert contacting the bolt and the rotator core to apply resistance in a circumferential direction.

22. The coin handling apparatus of claim 21 further characterized in that said sensor means are optical sensor means arranged with respect to said flag elements so that a light beam of said optical sensor means is interrupted each time a coin causes said rotator core to rotate.

23. The coin handling apparatus of claim 21 further characterized in that the rotary coin counter positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotary coin counter, rotor flag elements on said rotary coin counter arranged with respect to said lobes to interrupt a light beam of said optical sensor each time a coin is discharged from said coin discharge slot, said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotary coin counter to accommodate coins of different sizes.

24. The coin handling apparatus of claim 21 further characterized in that the rotary coin counter includes an optical sensor means and that the counting means is activated by said optical sensor means.

25. The coin handling apparatus of claim 21 further characterized in that the rotary coin counter positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotary coin counter and rotor flag elements on said rotary coin counter arranged with respect to said lobes to interrupt a light beam of an optical sensor each time a coin is discharged from said coin discharge slot.

26. A coin handling apparatus for receiving coins at a first location and discharging the coins at a second location through a coin discharge slot remote from the first location comprising means defining a coin transport channel extending from the first location to the second location dimensioned so that coins can move therein in a single, edge-to-edge file, the channel terminating at the coin discharge slot at the second location and a rotary coin counter positioned adjacent to said discharge slot, said rotary coin counter comprising a bolt fixedly connected to said transport channel, a rotator core having a central base disposed on said bolt for rotation thereon; means on said rotator core for contacting each coin as it moves through said coin transport channel toward said coin discharge slot for rotating said rotator core in response to coin movement, flag elements radially spaced apart on the outer portion of said rotator core for rotation therewith; sensor means positioned to be responsive to rotation of said flag elements for sensing passage of each coin through the coin discharge slot; counting means coupled to said sensor means for counting coins discharged through said coin discharge slot; and means for inhibiting-rotation of the rotator core in an undesirable direction characterized in that the means for inhibiting rotation of the rotator core includes ball bearings located in the rotator core permitting free rotation in one direction and resisting rotation in the opposite direction by applying a radially directed force.

27. The coin handling apparatus of claim 26 further characterized in that said sensor means are optical sensor means arranged with respect to said flag elements so that a light beam of said optical sensor means is interrupted each time a coin causes said rotator core to rotate.

28. The coin handling apparatus of claim 26 further characterized in that the rotary coin counter positioned adjacent to the coin discharge slot comprises a lobed rotator having at least three radially spaced apart lobes positioned so that one of said lobes contacts each coin as it enters the final portion of the coin transport channel just prior to leaving through the coin discharge slot to thereby rotate said rotary coin counter, rotor flag elements on said rotary coin counter arranged with respect to said lobes to interrupt a light beam of said optical sensor each time a coin is discharged from said coin discharge slot, said rotor flag elements including a plurality of spaced apart phase angle holes around the interior portion thereof and a detachable rotor mount keyed to said lobed rotator and having an alignment pin adapted to be selectively inserted into a selected phase angle hole to adapt the rotary coin counter to accommodate coins of different sizes.

29. The coin handling apparatus of claim 26 further characterized in that the rotary coin counter includes an optical sensor means and that the counting means is activated by said optical sensor means.

30. The coin handling apparatus of claim 26 further characterized in that the rotary coin counter positioned adjacent to the coin discharge slot comprises at least three radially spaced apart lobes positioned so that one of said lobes contacts each coin as it enters the final portion of the coin transport channel just prior to leaving through the coin discharge slot to thereby rotate said rotary coin counter and rotor flag elements on said rotary coin counter arranged with respect to said lobes to interrupt a light beam of an optical sensor each time a coin is discharged from said coin discharge slot.

* * * * *